United States Patent [19]

Morse

[11] 4,241,701

[45] Dec. 30, 1980

[54] METHOD AND APPARATUS FOR CONTROLLING STEAM TEMPERATURE AT A BOILER OUTLET

[75] Inventor: Richard H. Morse, Oreland, Pa.

[73] Assignee: Leeds & Northrup Company, North Wales, Pa.

[21] Appl. No.: 12,633

[22] Filed: Feb. 16, 1979

[51] Int. Cl.[3] ..... F22G 5/00

[52] U.S. Cl. ..... 122/460; 122/479 R; 122/487; 236/14; 318/561

[58] Field of Search ..... 122/460, 477, 478, 479 R, 122/487; 236/14; 318/561

[56] References Cited

U.S. PATENT DOCUMENTS

| | | | |
|---|---|---|---|
| 2,526,898 | 10/1950 | Powell et al. | 122/479 R |
| 2,806,192 | 9/1957 | Bristol | 318/610 |
| 3,515,102 | 6/1970 | Hamilton, Jr. | 122/479 |
| 3,601,588 | 8/1971 | Bristol | 318/561 |
| 3,758,762 | 9/1973 | Littman et al. | 318/361 |
| 3,902,111 | 8/1975 | Pfisterer, Jr. | 323/19 |
| 4,015,548 | 4/1977 | Schuss | 236/14 |
| 4,031,863 | 6/1977 | Läubli | 236/14 |

*Primary Examiner*—Henry C. Yuen
*Attorney, Agent, or Firm*—William G. Miller, Jr.; Raymond F. MacKay

[57] ABSTRACT

Boiler outlet temperature in a sliding pressure operation is controlled in a routine way by varying the fluid or heat distribution in the boiler. The effect a change in pressure has on steam temperature is anticipated by supplying a feedforward signal to the temperature control system from drum pressure so as to minimize temperature variations at the boiler outlet.

5 Claims, 1 Drawing Figure

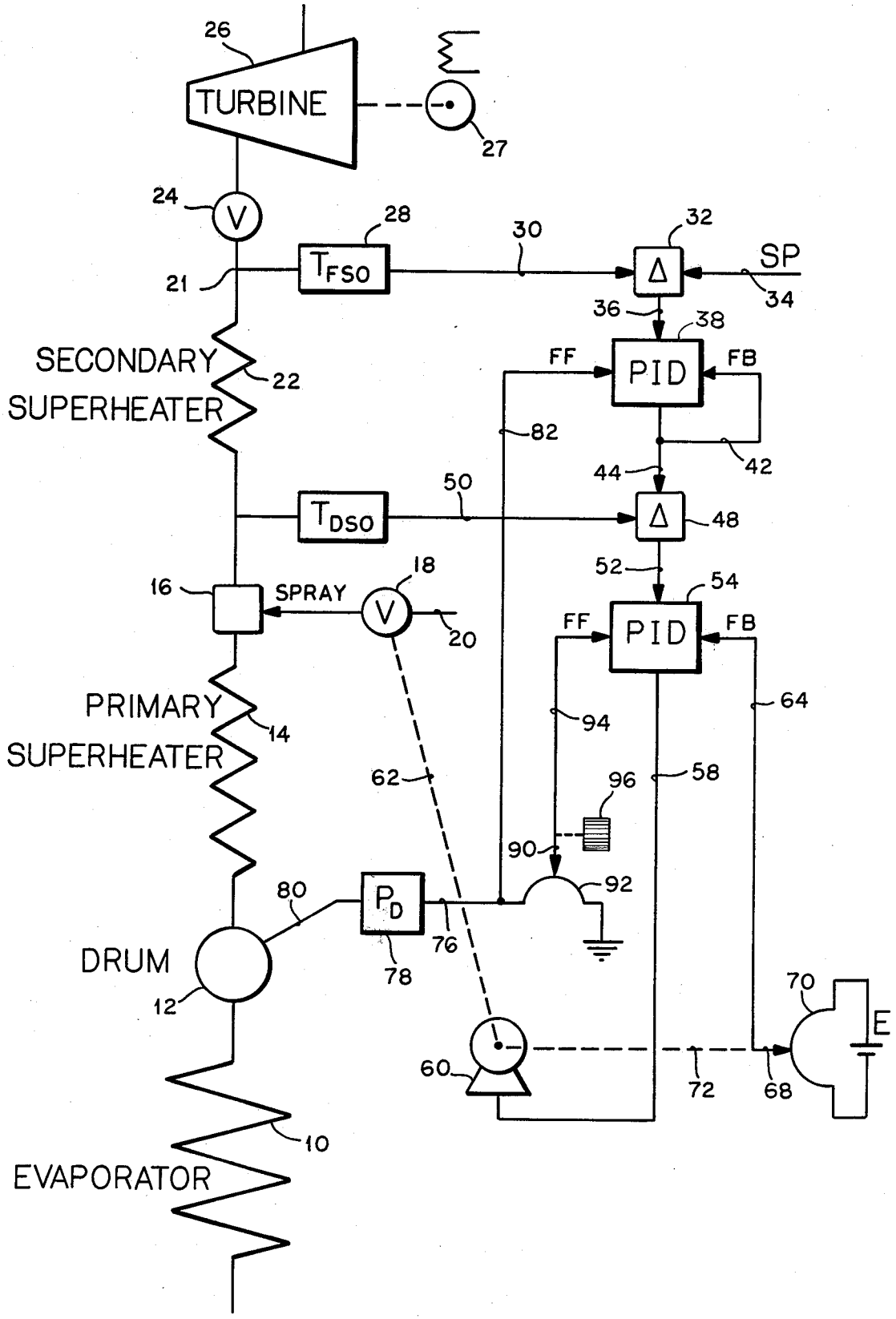
TURBINE
26
27
24
V
28
$T_{FSO}$
30
32
Δ
SP
34
21
36
38
PID
FF
FB
SECONDARY
SUPERHEATER
22
82
44
42
50
$T_{DSO}$
Δ
48
52
54
16
SPRAY
18
V
20
PID
FF
FB
64
PRIMARY
SUPERHEATER
14
94
62
58
96
90
92
80
$P_D$
76
78
DRUM
12
70
E
60
72
68
10
EVAPORATOR

METHOD AND APPARATUS FOR CONTROLLING STEAM TEMPERATURE AT A BOILER OUTLET

BACKGROUND OF THE INVENTION

This invention relates to a method and apparatus for providing an improved control of the steam temperature at the outlet of a boiler. More particularly, the invention provides for a method and apparatus for maintaining closer control of steam temperature at the outlet of a drum type boiler when that boiler is being operated in a sliding or variable pressure mode; that is, when the pressure is allowed to vary with changes in load on the boiler.

In boilers fired for the production of electrical power, the generation of steam takes place in two stages. Generation of saturated steam takes place in the evaporator section of the boiler and the saturated steam produced exists in the boiler drum along with water which is maintained at a desired level. The saturated steam is superheated to the desired temperature by one or more superheating sections in the boiler so that the steam generated at the outlet of the boiler is at appropriate pressure and temperature for use in a turbine connector to drive a generator.

Typically, the steam temperature at the boiler outlet must be controlled for proper operation of the turbine and the control of that temperature may be accomplished in various ways, depending upon the structural features of the boiler. Basically the control of steam temperature is accomplished by either modifying the fluid distribution in the boiler or by modifying the heat distribution. Thus, for example, the steam temperature may be controlled by modifying the amount of spray which is used to desuperheat or, alternatively, the steam or water may be bypassed around certain sections in the boiler as another means for modifying the temperature by changing the fluid distribution. Where it is desired to modify the heat distribution to control steam temperature, various approaches can be used; for example, tilting the burners or biasing the fuel supply to the upper burners with respect to the lower burners. Alternatively, gas recirculating can be controlled as a means for controlling the heat distribution or other means for gas flow distribution can be utilized.

It has been found that the pressure at which the boiler operates has a profound effect on the temperature simply by virtue of the characteristics of steam as represented by the heat of vaporization, the enthalpy of saturated steam at the drum, and the enthalpy in the superheated steam for a given temperature. It is the object of this invention to provide a method and means to compensate for the sustained effects of pressure variations on the temperature of the steam at the boiler outlet.

SUMMARY OF THE INVENTION

The temperature of the steam at the outlet of a drum type boiler in accordance with the provisions of this invention is controlled by modifying with a feedforward signal the control of the outlet temperature as it responds to the difference between the outlet temperature and its set point. The feedforward signal is proportional to the boiler drum pressure and is applied to the control in sense to tend to minimize change in temperature at the outlet due solely to changes in the drum pressure.

BRIEF DESCRIPTION OF THE DRAWING

The FIGURE shows in block diagram form one form of the control system of the invention as it is applied to a specific control arrangement for boiler outlet temperature.

DESCRIPTION OF THE PREFERRED EMBODIMENT

In the FIGURE there is shown an arrangement for a drum type boiler in which the evaporator section 10 is utilized to produce saturated steam in the steam drum 12 which has water maintained to a certain level. The saturated steam from the drum 12 is then passed through the primary superheater 14 where it is superheated to a certain extent. The superheated steam then passes through a spray desuperheater 16 to which a variable amount of water spray is applied as by the operation of the valve 18 which varies the amount of spray by controlling the water passing through the line 20 to the desuperheater 16. Following the desuperheater, the steam is passed through a secondary superheater 22 and thence through the outlet of the boiler 21 and through throttle valve 24 which serves to control the flow of steam to turbine 26 so as to vary the generation of electrical power by the generator 27 connected to the turbine.

In the operation of the boiler-turbine combination for the generation of electrical power, the throttle valve 24 is frequently adjusted as a means for controlling the power output of the boiler and hence the generator. Frequently the boiler is operated in the sliding of variable pressure mode so that as the valve 24 is opened or closed to change the steam flow to the turbine, the pressure at the boiler outlet is programmed to vary over a restricted range to minimize changes in valve 24. Even under conditions where pressure variations are programmed at the boiler outlet so that throttling valve 24 doesn't change the outlet temperature, it is still desirable to take all other possible steps to control as closely as possible the temperature of the steam at the outlet for the purpose of protecting the turbine blades from any unnecessary thermal changes which might be damaging.

With a boiler arrangement as shown in the FIGURE, one common way of controlling the boiler outlet temperature to a desired value is by use of a cascade control system such as that shown in the FIGURE. That cascade control system utilizes a measurement of the temperature, $T_{FSO}$, at the final superheater outlet point 21 by the temperature measuring instrument 28 which transmits a signal on line 30 representative of the temperature measured at the outlet. The signal on line 30 is then compared in comparator 32 to a signal on line 34 which is provided to represent the setpoint or desired value for the outlet temperature. The output of the comparator 32 on line 36 is then proportional to the error or the deviation of the outlet temperature from its setpoint. The error signal on line 36 then provides an input to the controller 38 which is shown as being a controller having proportional, integral, and derivative action. The controller 38 may, for example, be a Model 420 current-adjusting type process controller of the type presently marketed by Leeds & Northrup Company. The controller is shown as having its feedback provided over line 42 so that there is produced on the output line 44 a control signal which is representative of the setpoint or, in other words, the desired value for the temperature at the outlet of the desuperheater 16 which is the inlet to the secondary superheater 22. The comparator 48 is utilized to compare that setpoint as provided by the signal on line 44 with the signal on line 50 which represents $T_{DSO}$, the temperature at the desuperheater outlet.

The outlet of the comparator 48 is thus an error signal which is provided on line 52 as an input to controller 54 which controller has as its purpose the variation of the opening of the desuperheater spray valve 18 as is necessary to maintain the temperature at the desuperheater outlet $T_{DSO}$ at its setpoint. Thus, the controller 54 provides proportional, integral, and derivative action and produces on its output line 58 the necessary power pulses to change the position of motor drive unit 60 so as to modify the opening of valve 18 by way of a mechanical coupling therebetween, namely the coupling 62.

The controller 54 may advantageously be a Model 420 position-adjusting type process controller of the type presently manufactured by Leeds & Northrup Company. As will be evident from the drawing, the controller 54 has its feedback provided on line 64 by virtue of the adjustment of the tap 68 on potentiometer 70 in proportion to the position of the shaft of drive unit 60. Since the potentiometer 70 is supplied by a fixed potential, E, the voltage on line 64 varies directly with changes in position of the shaft of drive unit 60 by virtue of the mechanical coupling therebetween indicated by the reference number 72.

There has been described so far a commonly used cascade control system for controlling the temperature of the steam at the boiler outlet by modifying the amount of desuperheating which is effected between the primary and secondary superheaters. To carry out the present invention with the boiler arrangement shown in the FIGURE, namely wherein the control of the steam temperature is accomplished by changing the fluid distribution by the use of spray desuperheating, there is provided a feedforward signal proportional to boiler drum pressure. That signal is provided on line 76 by the pressure measuring instrument 78 which is connected to the drum 12 by a pressure tap 80 so that the feedforward signal on line 76 is proportional to the drum pressure. That feedforward signal is supplied over line 82 as a feedforward signal to controller 38. Thus, for example, if a type 420 current-adjusting controller is used for controller 38 it will include a feedforward amplifier for the purpose of introducing the feedforward signal on line 32 into the control circuit of controller 38.

As a result of the use of the feedforward signal 82 changes in drum pressure will provide for a change in the position of the spray desuperheating valve 18 which will compensate for the change in temperature at the boiler outlet resulting solely from a change in the pressure at which the boiler is operating as evidenced by the pressure change in the boiler drum 12. Thus the feedforward signal on line 82 provides an anticipatory control or, in other words, a control of valve 18 which is an anticipation of changes which would normally be detected by the temperature measuring instrument 28 long after the pressure change occurred and sometimes too late for appropriate adjustment of valve 18 for the maintenance of close control of the temperature at the outlet.

To further enhance the anticipatory effect of the feedforward control provided by the signal on line 82, a portion of that signal as determined by the manually adjusted tap 90 on potentiometer slidewire 92 is supplied to the feedforward signal input of controller 54 on line 94. By providing some feedforward to controller 54, the response to pressure changes in the drum is faster and hence the control of the outlet temperature may be maintained closer to its desired value. The particular position of tap 90 will be manually adjusted by the knob 96 in the tuning of the control system to provide for the desirable response in the temperature at the boiler outlet. Controller 54 must, of course, include a feedforward amplifier as a means for accommodating the feedforward signal as an input to the control circuit of the controller 54.

The controllers 38 and 54, if they are of the type previously described, utilize a circuit arrangement very similar to that shown in U.S. Pat. No. 3,902,111 issued to George J. Pfisterer, Jr., a coworker of mine, on Aug. 26, 1975, with the circuit arrangement of that patent as shown in its FIG. 1, the feedforward signal can be introduced into the feedback signal path at line 70 by use of an amplifier to provide an input at that point in the circuit. The circuit arrangement of the type 420 controller, as previously mentioned, differs from that in the above mentioned patent in that the output circuit 30 shown in the patent is replaced by an output circuit which differs in some respect although it will be evident that the specific circuit shown in the above mentioned patent can be utilized to provide the type of output required by controller 38. A slightly different output circuit would obviously be required to operate the drive unit 60 from controller 54.

It will be evident to those skilled in the art that when controlling the temperature at the boiler outlet where the boiler configuration does not utilize a primary and secondary superheater with an intermediate spray desuperheater, modification will be necessary in the control system for controlling the temperature, and the specific control system utilized will depend upon the configuration of the sections of the boiler and the method by which they accomplish either a change in fluid distribution or a change in heat distribution to control the outlet temperature. The control system utilized for controlling outlet temperature for the various boiler configurations which are available are well known and it is only necessary to carry out this invention to provide a feedforward signal by the control system for the drum pressure so as to provide the requisite anticipatory control to the final control element which controls the outlet temperature.

With the boiler arrangement shown in the FIGURE wherein desuperheating is utilized as a means for controlling the fluid distribution to control the outlet temperature, it will be evident that as the drum pressure increases, the amount of spray desuperheating will decrease. This is particularly evident when one considers the required changes in enthalpy both for evaporation and for superheating. For example, at a pressure of 500 psi, the enthalpy change required for evaporation is more than twice the enthalpy change required for superheating steam to a temperature of 1000° F. where that temperature is assumed to be the desired temperature at the boiler outlet. On the other hand, at a pressure of 2500 psi, the enthalpy change required for evaporation is approximately the same as that required for superheating the steam to 1000° F. Thus, if for example we assume a constant load on the boiler and constant firing rate to maintain that load, it will be evident that, relatively speaking, more heat is required to evaporate the steam than to superheat it at lower pressures and therefore there will be an excessive heating of the steam in the superheater sections unless a considerable amount of desuperheating is effected by the spray desuperheater at the lower pressures. Thus, desuperheating is required to an increasing extent as the boiler drum pressure decreases.

The feedforward signal to the controller 38 on line 82 should be applied to the controller in a sense to minimize the tendency of the boiler outlet temperature to increase when drum pressure decreases, which will thus prevent the temperature at the outlet from changing to an unnecessary degree in response to drum pressure changes.

What is claimed is:

1. In a drum type boiler having a superheater and a control system for modifying the fluid distribution or the heat distribution in said boiler to control the temperature of the steam at the outlet of said superheater wherein the control system includes a controller responsive to the difference between said outlet temperature and its set point for effecting said modification to control the temperature at said superheater outlet, the improvement which comprises:

means for producing a feedforward signal proportional to boiler drum pressure; and means responsive to said feedforward signal for modifying the control of said outlet temperature in sense to prevent the temperature at said superheater outlet from changing in response to drum pressure changes.

2. In a drum type boiler having a superheater and a control system for modifying the operation of said boiler to control the temperature of the steam at the outlet of said superheater wherein the control system includes a controller responsive to the difference between said outlet temperature and its set point for controlling the outlet temperature, the improvement which comprises:

means for producing a feedforward signal proportional to the drum pressure in the boiler; and means for applying said feedforward signal to said controller in such sense as to modify the control so as to tend to minimize changes in the temperature at said outlet due solely to drum pressure changes.

3. In a drum type boiler having primary and secondary superheater sections with a spray desuperheater between them and a control system for modifying the water flow to the desuperheater to control the temperature of the steam at the outlet of said secondary superheater wherein the control system includes a first controller responsive to the difference between said outlet temperature and its set point for controlling the set point of a second controller which responds to the difference between its set point and the inlet temperature of said secondary superheater, the improvement which comprises:

means for applying a feedforward signal to said control system to change the output of said first controller in response to said feedforward signal with the feedforward signal being proportional to the drum pressure in the boiler and the application of said feedforward signal being of sense to minimize the tendency of said secondary superheater outlet to increase when the drum pressure decreases.

4. Apparatus as set forth in claim 3 in which said feedforward signal is applied in attenuated form to the second controller so that the controller operates to control said desuperheater to provide an anticipatory control of the steam temperature which is independent of the action of said first controller.

5. A method for controlling the temperature of the steam at the outlet of the superheater of a drum type boiler operating in the sliding pressure mode, comprising the steps of:

automatically controlling the fluid distribution or the heat distribution in the boiler in response to the deviation of outlet temperature from its set point so as to tend to maintain said outlet temperature at its set point; and modifying said control in response to the magnitude of a feedforward signal proportional to the pressure of the steam in said drum, said modification being in sense to tend to reduce the temperature change expected solely as a result of changes in drum pressure.

* * * * *